United States Patent [19]

Ogata et al.

[11] Patent Number: 4,734,395

[45] Date of Patent: Mar. 29, 1988

[54] PRESSURE-SENSITIVE RECORDING SHEET

[75] Inventors: Yasuhiro Ogata; Masakazu Maekawa, both of Shizuoka, Japan

[73] Assignee: Fuji Photo Film Co., Ltd., Kanagawa, Japan

[21] Appl. No.: 871,353

[22] Filed: Jun. 6, 1986

[30] Foreign Application Priority Data

Jun. 6, 1985 [JP] Japan ..... 60-123164

[51] Int. Cl.[4] ..... B41M 5/22

[52] U.S. Cl. ..... 503/200; 427/150; 503/212; 503/226

[58] Field of Search ..... 346/200, 226, 210–212, 346/216, 225; 427/150–152

[56] References Cited

U.S. PATENT DOCUMENTS 4,255,491 3/1981 Igarashi ..... 346/200
4,567,496 1/1986 Ogata et al. ..... 346/200

FOREIGN PATENT DOCUMENTS 2032126A 4/1980 United Kingdom ..... 346/200

*Primary Examiner*—Bruce H. Hess
*Attorney, Agent, or Firm*—Sughrue, Mion, Zinn, Macpeak, and Seas

[57] ABSTRACT

A pressure-sensitive recording sheet is described, comprising a base paper having coated thereon a color developer solution wherein said base paper has been size-pressed or coated with a cationic sizing agent.

14 Claims, No Drawings

PRESSURE-SENSITIVE RECORDING SHEET

FIELD OF THE INVENTION

The present invention relates to a pressure-sensitive recording sheet, and, more particularly, to such a sheet that utilizes the coloring reaction between an electron-donating color former and an electron-accepting color developer.

BACKGROUND OF THE INVENTION

Pressure-sensitive recording sheets which utilize the coloring reaction between electron-donating color formers and electron-accepting color developers are widely known as no carbon required papers or pressure-sensitive copying papers and examples thereof are described in U.S. Pat. Nos. 2,711,375, 2,712,507, 2,730,456, 2,730,457, and 3,617,334; and Japanese Patent Publication Nos. 18317/63, 1178/72 and 20972/72.

A pressure-sensitive copying paper is generally composed of an upper sheet (CB (coated back) sheet) having coated with microcapsules containing an appropriate electron-donating color former in a suitable solvent and a lower sheet (CF (coated front) sheet) having coated with an electron-accepting color developer, or is composed of the upper sheet, the lower sheet, and an intermediate sheet (CFB (coated front and back) sheet) having coated with the microcapsules and coated with the color developer on the other surface thereof. In one embodiment, the upper sheet is superposed on the lower sheet so that the coated faces thereof face each other, or in another embodiment, one or more intermediate sheet are inserted between the upper sheet and the lower sheet. When pressure is applied to the above-constructed pressure-sensitive copying paper by a typewriter or handwriting, the microcapsules are ruptured to release the color former with the solvent, which is then transferred on to the surface of the color developer-containing layer to form colored image.

Such pressure-sensitive copying papers find much utility in such business forms as vouchers and paper for computer printout.

The most important requirements that should be met by the pressure-sensitive recording sheet are that it has an excellent coloring property upon application of the impact upon typing or the pressure of writing and that it undergoes a minimum degree of processing smudge, which is the smudge resulting from handling during manufacture or subsequent conversion treatment.

Smudge preventing particles have been extensively used with a view to minimizing the occurrence of smudge which results from the application of pressure during conversion, and known smudge preventing particles include fine cellulose powders (U.S. Pat. No. 2,711,375), starch particles (British Pat. No. 1,232,347; and Japanese Patent Publication Nos. 1178/72 and 33204/73), glass beads (U.S. Pat. No. 2,655,453), and heat expandable polymer particles (Japanese Patent Application (OPI) No. 322013/73, with the term "OPI" as used herein referring to an "unexamined published Japanese patent application"). The use of these protective agents is effective in minimizing the processing smudge but, at the same time, they reduce the density of the reproduced color image. Commercially, this problem can be solved by applying increased amounts of microcapsules or increasing the content of the color former within the microcapsules, but from the viewpoint of cost-effectiveness, neither method is economically desirable.

Methods have been proposed for solving the problem by applying microcapsules onto the surface precoated with microcapsule protecting agents such as starch or water-soluble polymers (as in Japanese Patent Application (OPI) Nos. 111288/80 and 87908/73; and U.S. Pat. Nos. 3,565,666, 3,914,470 and 3,219,220), but in fact the improvement attained is not as great as desired.

SUMMARY OF THE INVENTION

Therefore, the primary object of the present invention is to provide a pressure-sensitive recording sheet that undergoes a minimum degree of processing smudge (i.e., the smudge which results from handling during manufacture or subsequent conversion treatment) and which produces a high color density upon copying under the impact upon typing or the pressure of handwriting.

It has now been found that the object of the present invention can be achieved by a pressure-sensitive recording sheet comprising a base paper having coated thereon a color developer solution wherein said base paper has been size-pressed or coated with a cationic sizing agent.

DETAILED DESCRIPTION OF THE INVENTION

The cationic sizing agent which is preferably used in the present invention is selected from among polymers and copolymers of nitrogen-containing vinyl monomers, and salts thereof. Preferable examples of the nitrogen-containing vinyl monomer include vinylpridine, vinylquinoline, dimethylaminoethyl acrylate, dimethylaminoethyl methacrylate, 2-dimethylamino-1-methylethyl acrylate, 2-dimethylamino-1-methylethyl methacrylate, dimethylaminoethyl acrylamide, etc. Examples of monomers which are copolymerizable with such nitrogen-containing vinyl monomers include styrene, vinyltoluene, vinylnaphthalene, acrylic acid, $\alpha$-ethylacrylic acid, methacrylic acid, etc., but it should be understood that any monomers that are copolymerizable with the aforementioned nitrogen-containing vinyl monomers may be used.

The nitrogen-containing group in the nitrogen-containing monomer is preferably basic, and said monomer is preferably converted to a quaternary ammonium salt by treatment with a water-soluble acid such as hydrochloric acid or acetic acid, or with an alkyl halide such as benzyl chloride or butyl bromide.

The aforementioned salts of polymer or copolymers may be immediately used as cationic sizing agents but they ay be mixed with optionic components such as melamine resins or urea resins. If desired, the salts may be modified with epoxy groups, etc. so as to enhance the reactivity of the sizes.

The following water-soluble cationic polymers, cationic emulsions, cationic fine powders and cationic low-molecular weight organic compounds, all of which is less water repellent than the cationic sizing agents, may be employed either independently or in combination with the cationic sizes.

Usable water-soluble cationic polymers include poly(vinylbenzyltrimethylammonium chloride), poly(-dimethyldiallylammonium chloride), poly(dimethyldiallylammonium chloride-co-sulfur dioxide), polymethacryloyloxyethyl-$\beta$-hydroxyethyldimethylammonium chloride), poly(methacryloyloxyethyl-$\beta$- hydroxy-γ-chloropropyldimethylammonium chloride), poly(styrene-co-methacryloylxyethyl-βhydroxy-γ-chloropropyldimethylammonium chloride), poly(-vinylamine), poly(dimethylacrylamide), poly(dimethylaminopropylacrylamide), poly(ethyleneimine), quaternary poly(ethyleneimine), an ionene-type cationic polymer, polyamide/polyamine resin, polyamide/-polyamine/epichlorohydrin resin, poly-4-vinylpyridine, poly-4-vinyl-N-butylpyridinium bromide, poly-2-methyl-1-vinylimidazole, poly-1-vinyl-2,3-dimethyl imidazolinium methyl sulfate, poly-2-acryloxyethyldimethylsulfonium methylsulfate, dicyandiamide/formaldehyde condensate, cationic starch, and cationic poly(vinyl alcohol).

Usable cationic emulsions include poly(methylmethacrylate-co-dimethylaminoethyl methacrylate), poly(styrene-co-dimethylaminoethyl methacrylate), poly(vinylbenzyltrimethylammonium chloride-co-divinylbenzene-co-styrene), and poly(methacryloyloxyethyltrimethylammonium chloride-co-ethyleneglycol dimethacrylate-co-methyl methacrylate).

Usable cationic fine powders include a fine powder of urea-formaldehyde resin, a fine powder of benzoguanamine resin, a fine powder of anion-exchange resin, an alumina sol, and alumina white.

Usable cationic low-molecular weight organic compounds include triethylbenzylammonium chloride, tetramethylammonium chloride, trimethyl-β-hydroxy-γ-chloropropylammonium chloride, stearyltrimethylammonium chloride, stearyldimethylbenzylammonium chloride, a reaction product of an fatty acid and polyamine, and an epichlorophydrin-quaternized reaction product of aliphatic acid and polyamine.

The aforementioned cationic sizing agents are preferably coated or sizepressed by using an on-machine coater such as a sizepress coater, a Billblade coater, and/or a roll coater.

These cationic sizing agents are preferably coated or sizepressed in the form of an aqueous solution having a concentration of said cationic sizing agents of 30 wt % or less, more preferably 20 wt % or less, and particularly preferably 10 wt % or less.

These cationic sizing agents are preferably coated one sizepressed in an amount of from 0.01 to 5 g/m$^2$, more preferably from 0.05 to 4 g/m$^2$, and particularly preferably from 0.1 to 3 g/m$^2$ on solid basis.

The color developer solution used in the present invention contains color developer(s) having a property of accepting electrons or donating protons, and being an adsorptive or reactive compound capable of producing a color image by contact with a color former (described in more detail below). Examples of the color developer include clay minerals such as acid clay, bentonite, kaolin, etc., and organic compounds such as phenol-formaldehyde novolak, metal-treated novolak, a metal salt of an aromatic carboxylic acid, etc. For the purpose of the present invention, the organic color developers such as phenol-formalin novolak, metal-treated novolak, a metal salt of an aromatic carboxylic acid, etc. are preferably used. The particularly preferable developer of the present invention is a metal salt of an aromatic carboxylic acid such as zinc 3,5-di-α-methylbenzylsalicylate.

The color developer solution of the present invention may contain inorganic pigments such as talc, clay, aluminum hydroxide, calcium carbonate, kaolin, calcined kaolin, acid clay, diatomaceous earth, zeolite, active clay, zinc oxide, magnesium oxide, etc., and, as a binder, water-soluble high-molecular weight compounds such as a carboxylated styrene-butadiene latex, polyvinyl alcohol, starch, hydroxyethylcellulose, etc.

The color developer, inorganic pigment, etc. are preferably dispersed to form fine particles not larger than 8 m by means of a dispersing machine such as a sand mill, an Attritor ball mill, or horizontal type sand mill (Dyno mill), etc.

Various additives that may be incorporated in the color developer or the color former, such as binders, anti-oxidants, smudge preventing agents (protective substance or stilts) and surfactants, as well as the coating methods and the using methods thereof are described in U.S. Pat. Nos. 2,711,375, 3,625,736, British Pat. No. 1,232,347, Japanese Patent Application (OPI) Nos. 44012/75, 50112/75, 127718/75, 30615/75, U.S. Pat. Nos. 3,836,383, 3,846,331, etc.

The base paper having been sizepressed or coated with the cationic sizing agent of the present invention is coated with a solution of the color developer to provide a pressure-sensitive recording sheet which undergoes a minimum degree of processing smudge while affording an excellent coloring property.

The base paper used in the present invention is principally made from wood pulp, and may optionally contain synthetic pulp, organic fibers, or the like.

Sizing agents other than the cationic sizing agent of the present invention defined above may also be used in the present invention, and examples thereof include saponified rosin, a rosin emulsion, an alkenylsuccinate, an alkenyl succinic anhydride emulsion, an alkylketene dimer emulsion, a fatty acid salt, a reaction product of an aliphatic acid and a polyamine, a reaction product of an aliphatic acid, a polyamine and epichlorohydrin, a styrene-dimethylaminoethyl methacrylate copolymer, etc. Aluminum sulfate, a cationic polymer, etc. may be used as a size fixing agent.

Clay, talc, calcium carbonate, a urea resin fine powder, etc. may be used as a filler. Polyacrylamide, starch, etc. may be used to provide increased paper strength. A melamine resin, a urea resin, a polyamide/-polyamine/epichlorohydrin resin, etc. may be used to provide improved wet strength. Dye(s), fluorescent dye(s), etc. may be used as a tone controlling agent.

The base paper which are suitable for use in the present invention are those prepared by using a Fourdrinier paper machine with multi-cylinder dryers or a Fourdrinier paper machine with Yankee dryer.

A microcapsule-coated paper may be used in combination with the color developer-coated paper of the present invention. The microcapsules used in the microcapsule-coated paper have an average particle diameter of from 1 to 20 μm, and are prepared by encapsulating an oily liquid having dissolved therein basic colorless color former(s) with a wall-forming material composed of a high-molecular weight material or polymer which is insoluble in both water and the oily liquid. As the wall material a combination of a polycation (e.g., gelatin) and a polyanion (e.g., gum arabic) or the combination of polycondensation system components (e.g., polyisocyanate-polyamine, polyisocyanate-polyol, urea-formaldehyde, or melamine-formaldehyde), and the like are used.

Methods for producing such microcapsules include a phase separation method from an aqueous solution (e.g., U.S. Pat. Nos. 2,800,457, 2,800,458, Japanese Patent Publication Nos. 16166/72, 32755/79, etc.), an external polymerization method (e.g., Japanese Patent Publication No. 12518/63, Japanese Patent Application (OPI) Nos. 42380/72, 8780/75, 9079/76, 66878/77, 84881/78, 84883/78, etc.), an interface polymerization method (e.g., Japanese Patent Publication Nos. 19574/63, 446/67, 771/67, 2882/67, 2883/67, 8693/67, 9654/67, 11344/67, British Pat. Nos. 950,443, 1,046,409, etc.), a method of polymerizing a wall-forming material in oil droplets (e.g., Japanese Patent Publication Nos. 9168/61, 45133/74, etc.), and a melting, dispersing and cooling method (e.g., British Pat. Nos. 952,807, 965,074, etc.).

The color former for use in this invention has a property of coloring by giving electron or receiving a proton of acid, etc., and there is no particular restriction on the kind of color formers. Usually, a substantially colorless compound including a partial skeleton such as lactone, lactam, sultone, spiropyran, ester, amide, etc., undergoes ring opening or cleavage by contact with the color developer. Practical examples of the colorless color former are Crystal Violet lactone, Benzoyl Leucomethylene Blue, Malachite Green lactone, Rhodamine B lactam, 1,3,3-trimethyl-6'-ethyl-8'-butoxyindolinobenzspiropyran, etc.

These color formers are encapsulated after being dissolved in solvents.

The solution of a color developer and the microcapsules of a color former may be coated by means of known coating methods, such as a blade coating method, an air knife coating method, a bar coating method, a rod coating method, a roller coating method, a Billblade coating method, a curtain coating method, a fountain blade coating method, a gravure coating method, a spray coating method, a dip coating method, an extrusion coating method, etc. If desired, appropriate printing or coating methods may be employed to perform partial printing.

Aids which are conventionally well known in the manufacture of pressure-sensitive copying papers may be appropriately used, and including dispersing agents (e.g., sodium alginate and sodium polyacrylate), viscosity controlling agents, anti-foaming agents, etc.

The thus prepared pressure-sensitive recording sheet of the present invention exhibits superior coloring properties in that it affords a high coloring density upon copying under the impact upon typing or the pressure of handwriting while it will undergo a minimum degree of smudge under the application of processing pressures in the order of from 5 to 20 kg/m$^2$.

The present invention will be described in greater detail with reference to the following examples, which in no sense limit the invention. In the following description, all parts by weight and percents by weight will be abbreviated simply as "parts" and "%", respectively. All coated amounts are based on dry weight.

The microcapsule-coated paper and the coating solution of color developer which were employed in the examples and comparative examples were prepared by the following procedures.

PREPARATION OF MICROCAPSULE-COATED PAPER

An o/w (oil-in-water) type emulsion having a mean particle size of 4.5 μm was prepared by dispersing 100 parts of diisopropylnaphthalene containing 2.5% of crystal violet lactone and 2% of benzoyl leuco methylene blue in 100 parts of a 4.4% aqueous solution of a partial sodium salt of polyvinylbenzene-silfonic acid (mean molecular weight of 500,000) having adjusted pH of 4.

Apart from this, a mixture of 6 parts of melamine, 11 parts of a 37% aqueous formaldehyde solution, and 83 parts of water was stirred at 60° C. for 30 minutes to provide a transparent aqueous solution of a mixture of melamine, formaldehyde, and a melamine-formaldehyde initial condensate. The aqueous solution of the mixture was mixed with the above-described emulsion, the pH of the resultant mixture was adjusted to 6.0 using an aqueous 20% acetic acid solution with stirring, then the temperature of the mixture was raised to 65° C., and the mixture was maintained at that temperature for 30 minutes to complete the microcapsulation.

To the resulting solution, 200 parts of 20% aqueous solution of etherized starch, 47 parts of starch particles (average size: 40 m) and 10 parts of talc were added. To the mixture, 32 parts of 2% aqueous solution of sodium dioctylsulfosuccinate was added and the solids content was adjusted to 20% by addition of water to produce a microcapsule coating solution. The thus prepared coating solution was coated on a base paper (TAPPI basis weight: 40 g/m$^2$) in an amount of 4.5 g/m$^2$ on a dry basis, thereby producing a microcapsule-coated paper.

Preparation of developer-coated paper:

After dispersing 25 parts of active clay, 75 parts of calcium carbonate, 10 parts of zinc oxide, 10 parts of zinc 3,5-di-α-methylbenzylsalicylate, and 1 part of sodium hexametaphosphate in 200 parts of water by means of a Kady mill, the dispersion was further finely dispersed using a horizontal type sand mill (DYNO-MILL, made by Willy A. Bachofen AG Machinenfabric) until the volume average particle size thereof became less than 3 μm. The volume average particle size (ϕ) is determined by the following relationships:

$$\frac{4}{3}\pi\left(\frac{\phi}{2}\right)^3 = \left(\frac{\text{The total volume of particles}}{\text{The total number of particles}}\right)$$

$$\phi = \frac{6}{\pi}\left(\frac{\text{The total volume of particles}}{\text{The total number of particles}}\right)^{\frac{1}{3}}$$

The dispersion thus obtained was added to a mixed binder of 125 parts of an 8% aqueous solution of polyvinyl alcohol (PVA-117, trademark for product made by Kuraray Co., Ltd.) and 10 parts (as solid component) of a carboxylated styrene-butadiene rubber latex (SN-304, trademark for product made by Sumitomo Naugatuc Co., Ltd.) with stirring, and then water was added to the mixture, so that the thus-obtained solid content concentration thereof became 20 wt %, to provide a developer coating composition.

EXAMPLE 1

A base paper (TAPPI basis weight: 40 g/m$^2$) was made from a mixed pulp of 70 parts of LBKP (Laubholz bleached kraft pulp) and 30 parts of NBKP (Nadelholz bleached kraft pulp) incorporating rosin (1 part) and aluminum sulfate (2 parts). The paper was sizepressed with 20 parts of epichlorohydrin-quaternized hydrochloride of poly(styrene-codimethylaminoethyl methacrylate) (molar copolymerization ratio: 80:20) which was a cationic sizing agent, in admixture with 80 parts of oxidized starch, so as to be a coated weight of 1 g/m$^2$ on a dry basis. After drying, thus size-pressed base paper was coated by means of an air knife coater with the solution of color developer (see above) in a weight of 5 g/m$^2$ on a dry basis and dried to make a lower sheet.

EXAMPLES 2 TO 5

Lower sheets were prepared in the same manner as in Example 1 except that the base papers were sizepressed with the various cationic sizing agents in a coated amount of 0.2 g/m$^2$ (on a dry basis) listed in Table 1 below.

TABLE 1

| Example No. | Sizing Agents |
|---|---|
| 2 | poly(methyl methacrylate-co-2-methacryloyloxy-ethyltrimethylammonium chloride) (molar copolymerization ratio: 80:20) |
| 3 | poly(styrene-co-2-methacryloyloxyethyldimethyl-benzylammonium chloride) (molar copolymerization ratio: 70:30) |
| 4 | cationic starch and the cationic sizing agent of Example 1 (as mixed at a ratio of 1:1) |
| 5 | acid addition product of α-olefin and maleic anhydride, as subsequently reacted with ethylene-diamine |

COMPARATIVE EXAMPLE 1

A lower sheet was prepared in the same manner as in Example 1 except that the base paper was sizepressed with oxidized starch in a coated amount of 1.0 g/m$^2$ (on a dry basis).

COMPARATIVE EXAMPLE 2

A lower sheet was prepared in the same manner as in Example 1 except that the base paper was sizepressed with a mixture of oxidized starch (70 parts), polyvinyl alcohol (25 parts) and carboxymethyl cellulose (5 parts) in a coated amount of 1.0 g/m$^2$ (on a dry basis).

The above obtained samples of lower sheet were evaluated for the coloring property (density attainable by application of the impact upon typing) and the resistance to processing smudge by the following procedures.

COLOR DENSITY UPON APPLICATION OF TYPING IMPACT

The upper sheet (i.e., the previously prepared microcapsule-coated paper) was placed on the lower sheet (i.e., the developer-coated paper), so as to face the coated surfaces thereof, and an impact was applied by striking the upper face with letter m's on a typewriter at close intervals, thereby causing a color image. Twenty-four hours later, the coloring density of the image was measured with a spectrophotometer.

PROCESSING SMUDGE DENSITY

The upper sheet was placed on the lower sheet, so as to face the coated surfaces thereof and applied thereto a pressure of 10 kg/cm$^2$ with a hydraulic pressure gauge capable of exerting varying pressures thereby the coloring reaction was occurred. Twenty-four hours later, the reflection density at the wavelength of 610 mμ was measured with a spectrophotometer (Hitachi Color Analyzer Model 307).

The results obtained are shown in Table 2 below.

TABLE 2

| Sample | Density of application of typing impact | Processing smudge |
|---|---|---|
| Example 1 | 0.41 | 0.15 |
| Example 2 | 0.40 | 0.16 |
| Example 3 | 0.43 | 0.17 |
| Example 4 | 0.38 | 0.14 |
| Example 5 | 0.42 | 0.16 |
| Comparative Example 1 | 0.35 | 0.20 |
| Comparative Example 2 | 0.33 | 0.21 |

As is apparent from Table 2, the pressure-sensitive recording sheet prepared in accordance with the present invention produces a high coloring density upon application of a typing impact while undergoing only a small degree of processing smudge.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet comprising a base paper having coated thereon a color developer solution wherein said base paper has been sizepressed or coated with a cationic sizing agent.

2. A pressure-sensitive recording sheet as claimed in claim 1, wherein said cationic sizing agent is selected from the group consisting of a homopolymer or copolymer of a nitrogen-containing vinyl monomer, and a salt of said homopolymer or copolymer.

3. A pressure-sensitive recording sheet as in claim 2, wherein said nitrogen-containing vinyl monomer is selected from the group consisting of vinylpyridine, vinylquinoline, dimethylaminoethyl acrylate, dimethylaminoethyl methacrylate, 2-dimethylamino-1-methylethyl acrylate, 2-dimethylamino-1-methylethyl methacrylate, dimethylaminoethyl acrylamide.

4. A pressure-sensitive recording sheet as in claim 2, wherein said nitrogen-containing monomer is basic, and said nitrogen-containing vinyl monomer is converted to a quaternary ammonium salt by treatment with a water-soluble acid or an alkyl halide.

5. A pressure-sensitive recording sheet as in claim 1, wherein the color developer contained in said color developer solution is an organic color developer.

6. A pressure-sensitive recording sheet as in claim 5, wherein said organic color developer is selected from the group consisting of phenol-formaldehyde novolak, metaltreated novolak, and a metal salt of an aromatic carboxylic acid.

7. A pressure-sensitive recording sheet as in claim 6, wherein said color developer is a metal salt of an aromatic carboxylic acid.

8. A pressure-sensitive recording sheet as in claim 7, wherein said metal salt of an aromatic carboxylic acid is zinc 3,5-di-α-methylbenzylsalicylate.

9. A pressure-sensitive recording sheet as in claim 1, wherein the coated or sizepressed amount of said cationic sizing agent is in the range of from 0.01 to 5 g/m$^2$ on solid basis.

10. A pressure-sensitive recording sheet as in claim 9, wherein the coated or sizepressed amount of said cationic sizing agent is in the range of from 0.05 to 4 g/m$^2$ on solid basis.

11. A pressure-sensitive recording sheet as in claim 10, wherein the coated or sizepressed amount of said cationic sizing agent is in the range of from 0.1 to 3 $g/m^2$ on solid basis.

12. A pressure-sensitive recording sheet as in claim 1, wherein said cationic sizing agent is coated or sizepressed in the form of an aqueous solution having a concentration of said cationic sizing agent of 30 wt % or less.

13. A pressure-sensitive recording sheet as in claim 12, wherein said cationic sizing agent is coated or sizepressed in the form of an aqueous solution having a concentration of said cationic sizing agent of 20 wt % or less.

14. A pressure-sensitive recording sheet as in claim 13, wherein said cationic sizing agent is coated or sizepressed in the form of an aqueous solution having a concentration of said cationic sizing agent of 10 wt % or less.

* * * * *